US011454904B2

(12) United States Patent
Iikura

(10) Patent No.: US 11,454,904 B2
(45) Date of Patent: Sep. 27, 2022

(54) IMAGE FORMING APPARATUS HAVING DETACHABLE IMAGE BEARING AND TRANSFER BELT MECHANISMS

(71) Applicant: FUJIFILM Business Innovation Corp., Tokyo (JP)

(72) Inventor: Kazuaki Iikura, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/929,761

(22) Filed: Jul. 15, 2020

(65) Prior Publication Data

US 2021/0278784 A1 Sep. 9, 2021

(30) Foreign Application Priority Data

Mar. 9, 2020 (JP) ..... JP2020-040309

(51) Int. Cl.
*G03G 15/16* (2006.01)

(52) U.S. Cl.
CPC ..... *G03G 15/1605* (2013.01)

(58) Field of Classification Search
CPC ..... G03G 15/1605; G03G 21/185; G03G 21/168; G03G 21/1846; G03G 21/1842; G03G 15/161
USPC ..... 399/117, 121
See application file for complete search history.

(56) References Cited

U.S. PATENT DOCUMENTS 6,463,236 B2 * 10/2002 Morikami ..... G03G 21/1619 399/121
7,526,227 B2 * 4/2009 Sato ..... G03G 15/16 399/110

FOREIGN PATENT DOCUMENTS

JP 2016-177091 A 10/2016

* cited by examiner

*Primary Examiner* — Arlene Heredia
(74) *Attorney, Agent, or Firm* — Sughrue Mion, PLLC

(57) ABSTRACT

An image forming apparatus includes an image bearing mechanism and a transfer belt mechanism. The image bearing mechanism is attachable to and detachable from an apparatus body in a first direction and supports multiple image bearing members. Each image bearing member has a surface onto which an image is formed while the image bearing member rotates. The transfer belt mechanism includes a transfer belt onto which the images on the multiple image bearing members are transferred while the image bearing members rotate. The transfer belt mechanism is attachable to and detachable from the apparatus body in a second direction different from the first direction.

10 Claims, 14 Drawing Sheets

IMAGE FORMING APPARATUS HAVING DETACHABLE IMAGE BEARING AND TRANSFER BELT MECHANISMS

CROSS-REFERENCE TO RELATED APPLICATIONS

This application is based on and claims priority under 35 USC 119 from Japanese Patent Application No. 2020-040309 filed Mar. 9, 2020.

BACKGROUND

(i) Technical Field

The present disclosure relates to image forming apparatuses.

(ii) Related Art

An image-formation-related unit disclosed in Japanese Unexamined Patent Application Publication No. 2016-177091 includes an operable member having a first operation position where the operable member partially or entirely covers an inserting area for a cleaning tool that cleans a cleaning target to be cleaned. The operable member is provided with a cutout or opening in an area that faces the inserting area for the cleaning tool when the operable member is disposed at the first operation position. Such a cutout or opening allows the cleaning tool to extend therethrough.

SUMMARY

A known image forming apparatus is provided with a transfer belt mechanism having a transfer belt and an image bearing mechanism having multiple image bearing members that retain images to be transferred onto the transfer belt. In this image forming apparatus, the transfer belt mechanism and the image bearing mechanism are attachable to and detachable from the apparatus body. The direction in which the transfer belt mechanism is attached to and detached from the apparatus body is the same as the direction in which the image bearing mechanism is attached to and detached from the apparatus body. Therefore, in order to attach or detach each mechanism to or from the apparatus body, the frame of the apparatus body has to have a large opening.

However, when the frame serving as a structural member has such a large opening, the rigidity of the frame decreases. In order to maintain the rigidity of the frame, the frame has to be increased in size, or the frame has to be increased in wall thickness.

Aspects of non-limiting embodiments of the present disclosure relate to suppressing an increase in size of the frame and an increase in wall thickness of the frame, as compared with a case where the direction in which the transfer belt mechanism is attached to and detached from the apparatus body is the same as the direction in which the image bearing mechanism is attached to and detached from the apparatus body.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including an image bearing mechanism and a transfer belt mechanism. The image bearing mechanism is attachable to and detachable from an apparatus body in a first direction and supports multiple image bearing members. Each image bearing member has a surface onto which an image is formed while the image bearing member rotates. The transfer belt mechanism includes a transfer belt onto which the images on the multiple image bearing members are transferred while the image bearing members rotate. The transfer belt mechanism is attachable to and detachable from the apparatus body in a second direction different from the first direction.

BRIEF DESCRIPTION OF THE DRAWINGS

An exemplary embodiment of the present disclosure will be described in detail based on the following figures, wherein.

DETAILED DESCRIPTION

An example of an image forming apparatus according to an exemplary embodiment of the present disclosure will be described below with reference to FIGS. 1 to 14. In each of the drawings, an arrow H indicates an apparatus up-down direction (i.e. vertical direction), an arrow W indicates an apparatus width direction (i.e., horizontal direction), and an arrow D indicates an apparatus depth direction (i.e., horizontal direction).

Image Forming Apparatus 10

Figure 14:
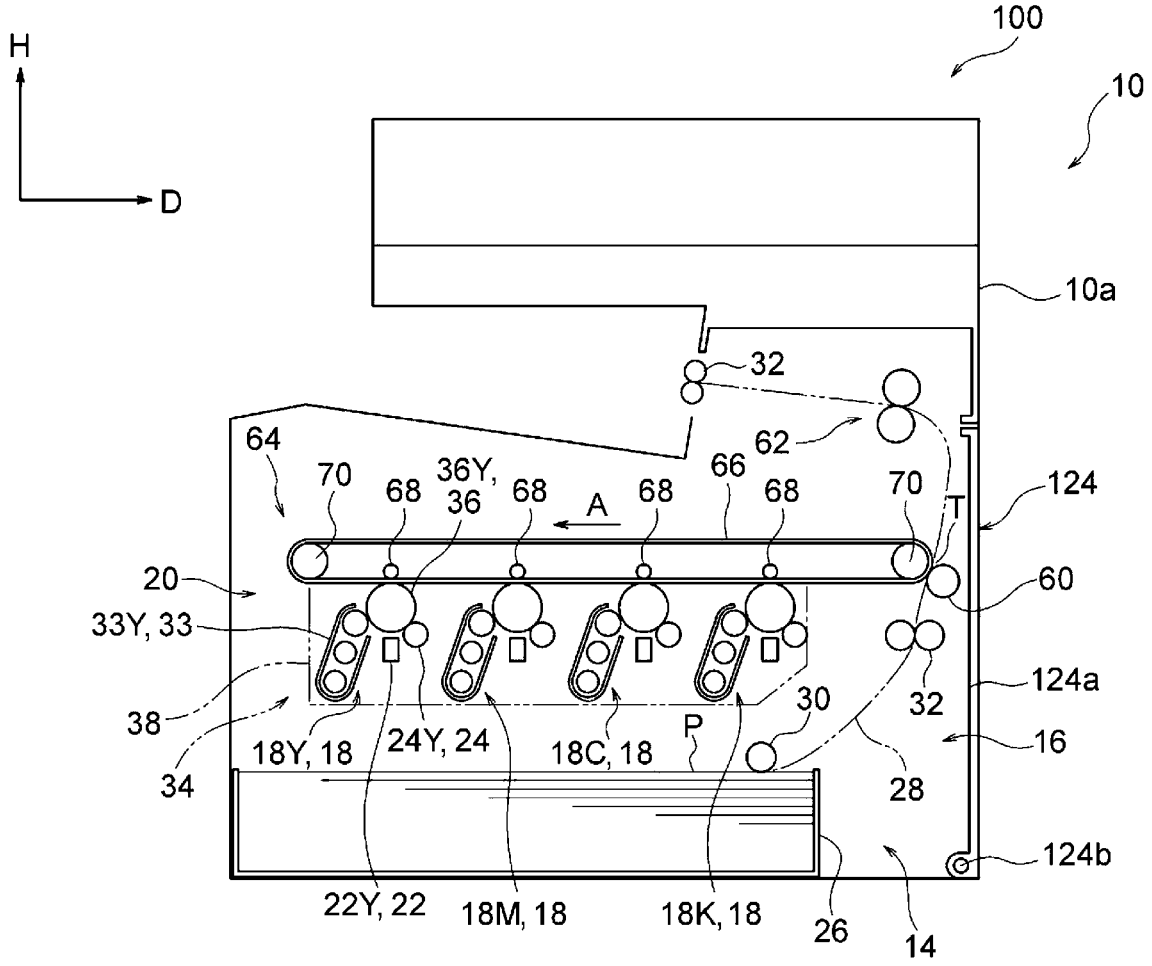
FIG. 14 is an overall view illustrating the configuration of the image forming apparatus according to the exemplary embodiment of the present disclosure.

As shown in FIG. 14, an image forming apparatus 10 according to this exemplary embodiment includes, in the following order from bottom to top in the apparatus up-down direction (indicated by the arrow H), a container 14 that contains at least one sheet member P as a recording medium, a transporter 16 that transports the sheet member P contained in the container 14, an image former 20 that forms an image onto the sheet member P transported from the container 14 by the transporter 16, and an image reader 100 that reads an image from a document.

Container 14

The container 14 includes a container member 26 that is drawable forward in the apparatus depth direction from an apparatus body 10*a* of the image forming apparatus 10. One or more sheet members P are loaded in this container member 26. Moreover, the container 14 also includes a delivery roller 30 that delivers the uppermost sheet member P loaded in the container member 26 to a transport path 28 included in the transporter 16.

Transporter 16

The transporter 16 includes multiple transport rollers 32 that transport the sheet member P along the predetermined transport path 28.

Image Former 20

The image former 20 includes an image bearing mechanism 34 provided with image forming units 18Y, 18M, 18C, and 18K for four colors, namely, yellow (Y), magenta (M), cyan (C), and black (K) colors. Moreover, the image former 20 includes exposure devices 22Y, 22M, 22C, and 22K that radiate exposure light toward image bearing members 36Y, 36M, 36C, and 36K provided in the respective image forming units 18Y, 18M, 18C, and 18K. In the following description, if the Y, M, C, and K colors are not to be distinguished from one another, the reference signs Y, M, C, and K may sometimes be omitted.

Furthermore, the image former 20 includes a transfer belt mechanism 64 provided with an endless transfer belt 66 rotating in a direction indicated by an arrow A and first-transfer rollers 68 that transfer toner images formed by the individual image forming units 18 onto the transfer belt 66.

The image former 20 also includes a second-transfer roller 60 that transfers the toner images on the transfer belt 66 onto the sheet member P, and a fixing device 62 that applies heat and pressure onto the sheet member P so as to fix the toner images onto the sheet member P.

Image Bearing Mechanism 34

The image bearing mechanism 34 includes the four image forming units 18 and a housing 38 that collectively accommodates the four image forming units 18 therein.

Each image forming unit 18 includes an image bearing member 36 whose rotation axis extends in the apparatus width direction, a charging roller 24 that electrostatically charges the surface of the image bearing member 36, and a developing device 33 that develops an electrostatic latent image, formed as a result of the electrostatically-charged surface of the image bearing member 36 being irradiated with exposure light, into a visible toner image. The image forming units 18Y, 18M, 18C, and 18K are arranged in this order from the front side toward the rear side in the apparatus depth direction. The term "front side in the apparatus depth direction" refers to the side facing the user using the image forming apparatus 10. A detailed description of the image bearing mechanism 34 will be provided later.

Exposure Devices 22

The multiple exposure devices 22 are provided for the individual colors, and are disposed below the individual image bearing members 36 so as to face the image bearing members 36 in the apparatus up-down direction. The exposure devices 22 are attached to the apparatus body 10*a* of the image forming apparatus 10.

In this configuration, each exposure device 22 radiates exposure light onto the electrostatically-charged surface of the corresponding image bearing member 36, so as to form an electrostatic latent image on the surface of the image bearing member 36.

Transfer Belt Mechanism 64

The transfer belt mechanism 64 includes the transfer belt 66, the first-transfer rollers 68, a pair of rollers 70 that have the transfer belt 66 wrapped therearound and whose rotation axes extend in the apparatus width direction, and frames 74 and 76 (see FIG. 11) that collectively support these components.

The pair of rollers 70 are separated from each other in the apparatus depth direction. The transfer belt 66 is wrapped around the pair of rollers 70. The image bearing members 36 are in contact with the transfer belt 66 from below the transfer belt 66. Furthermore, the multiple first-transfer rollers 68 are provided for the individual colors and are disposed opposite the image bearing members 36 with the transfer belt 66 interposed therebetween.

In this configuration, one of the rollers 70 rotates by receiving a rotational driving force, thereby causing the transfer belt 66 to rotate in the direction of the arrow A. Moreover, the first-transfer rollers 68 transfer the toner images formed on the image bearing members 36 onto the rotating transfer belt 66. A detailed description of the transfer belt mechanism 64 will be provided later.

Second-Transfer Roller 60 and Fixing Device 62

The second-transfer roller 60 is disposed opposite the roller 70 at the rear side in the apparatus depth direction with the transfer belt 66 interposed therebetween. The transport path 28 for the sheet member P extends between the transfer belt 66 and the second-transfer roller 60.

The fixing device 62 is disposed downstream of the second-transfer roller 60 in the transport direction of the sheet member P.

In this configuration, the second-transfer roller 60 transfers the toner images transferred on the rotating transfer belt 66 onto the sheet member P transported by the transport rollers 32. Furthermore, the fixing device 62 fixes the toner images transferred on the sheet member P onto the sheet member P.

Image Reader 100

Figure 3:
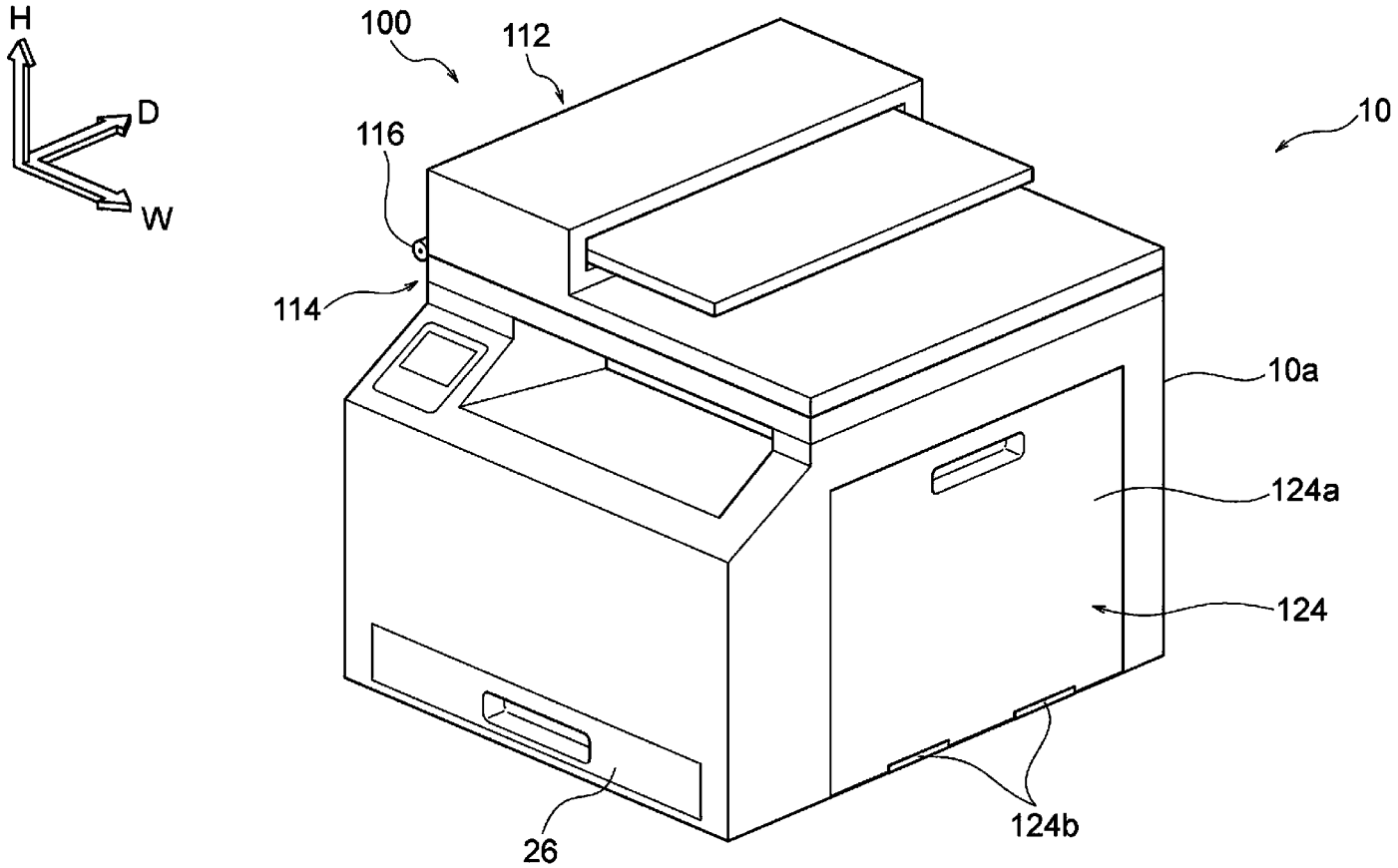
FIG. 3 is an overall perspective view of the image forming apparatus according to the exemplary embodiment of the present disclosure, illustrating a state where the first and second doors are disposed at their closed positions.

As shown in FIG. 3, the image reader 100 is disposed at an upper part of the apparatus body 10*a* and includes a document transporter 112 that transports a document and a document reader 114 that reads a document. The document transporter 112 and the document reader 114 are connected by a hinge 116. The document transporter 112 rotates about the hinge 116, so that the document transporter 112 exposes and covers platen glass (not shown) provided in the document reader 114.

In this configuration, the image reader 100 reads an image from a document transported by the document transporter 112 or an image from a document placed on the platen glass.

Operation of Image Forming Apparatus

In the image forming apparatus 10, an image is formed as follows.

The image reader 100 shown in FIG. 3 reads an image from a document transported by the document transporter 112 or an image from a document placed on the platen glass.

Furthermore, each charging roller 24 shown in FIG. 14 receives voltage and negatively charges the surface of the corresponding image bearing member 36 uniformly with a predetermined potential. Then, based on image data of the image read by the image reader 100, each exposure device 22 radiates exposure light onto the electrostatically-charged surface of the corresponding image bearing member 36, thereby forming an electrostatic latent image thereon.

Accordingly, electrostatic latent images corresponding to the image data are formed on the surfaces of the image bearing members 36. Moreover, the developing devices 33 develop these electrostatic latent images into visible toner images. The toner images formed on the surfaces of the image bearing members 36 are transferred onto the rotating transfer belt 66 by the first-transfer rollers 68.

The sheet member P delivered to the transport path 28 from the container member 26 by the delivery roller 30 is delivered to a transfer position T where the transfer belt 66 and the second-transfer roller 60 are in contact with each other. At the transfer position T, the sheet member P is transported by being nipped between the transfer belt 66 and the second-transfer roller 60, so that the toner images on the surface of the transfer belt 66 are transferred onto the sheet member P.

The toner images transferred on the sheet member P are fixed onto the sheet member P by the fixing device 62. The sheet member P having the toner images fixed thereon is output outside the apparatus body 10*a* by the transport rollers 32.

Relevant Configuration

Next, the configuration of the image bearing mechanism 34, the transfer belt mechanism 64, and a part of the apparatus body 10*a* to which the image bearing mechanism 34 and the transfer belt mechanism 64 are attached will be described.

Apparatus Body 10*a*

Figure 2:
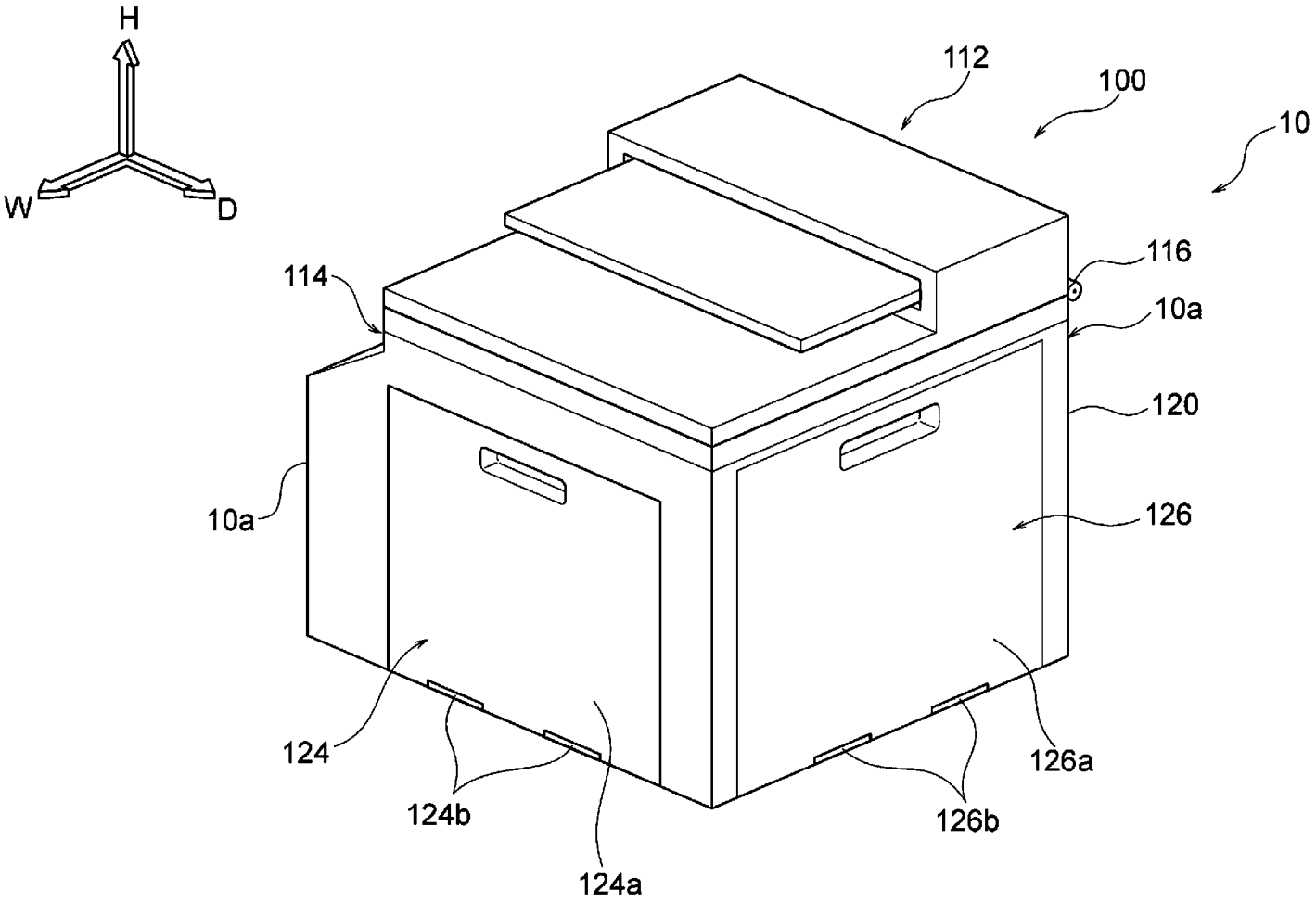
FIG. 2 is an overall perspective view of the image forming apparatus according to the exemplary embodiment of the present disclosure, illustrating a state where the first and second doors are disposed at their closed positions.

As shown in FIG. 2, the apparatus body 10*a* includes a housing 120 that accommodates components therein. Furthermore, the housing 120 includes a door 124 that exposes the interior of the apparatus body 10*a* toward a first side (i.e., left side) in the apparatus width direction, and a door 126 that exposes the interior of the apparatus body 10*a* toward the rear side in the apparatus depth direction.

Figure 5:
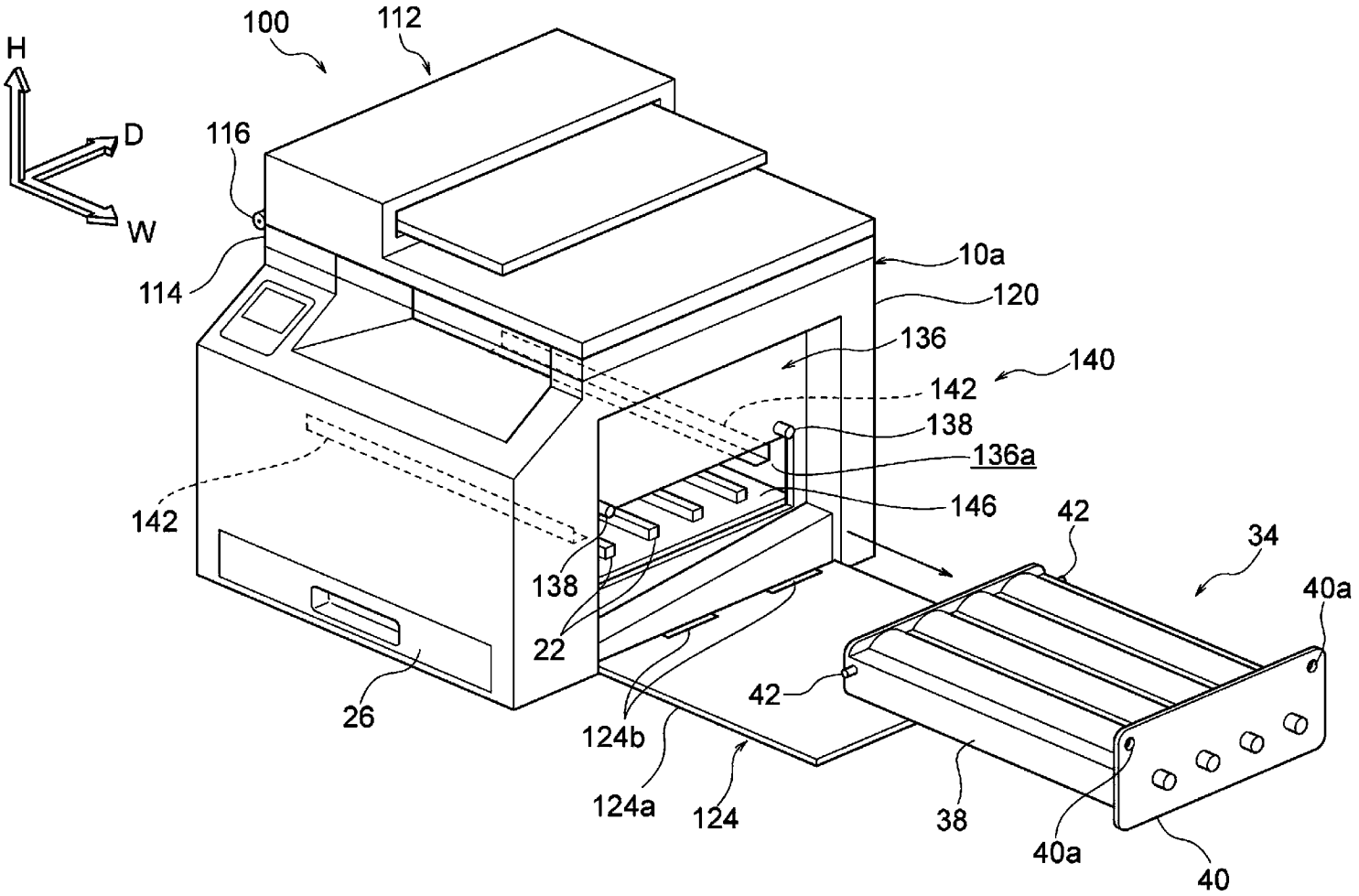
FIG. 5 is an overall perspective view of the image forming apparatus according to the exemplary embodiment of the present disclosure, illustrating a state where the first door is disposed at its open position and an image bearing mechanism is detached.
Figure 9A:
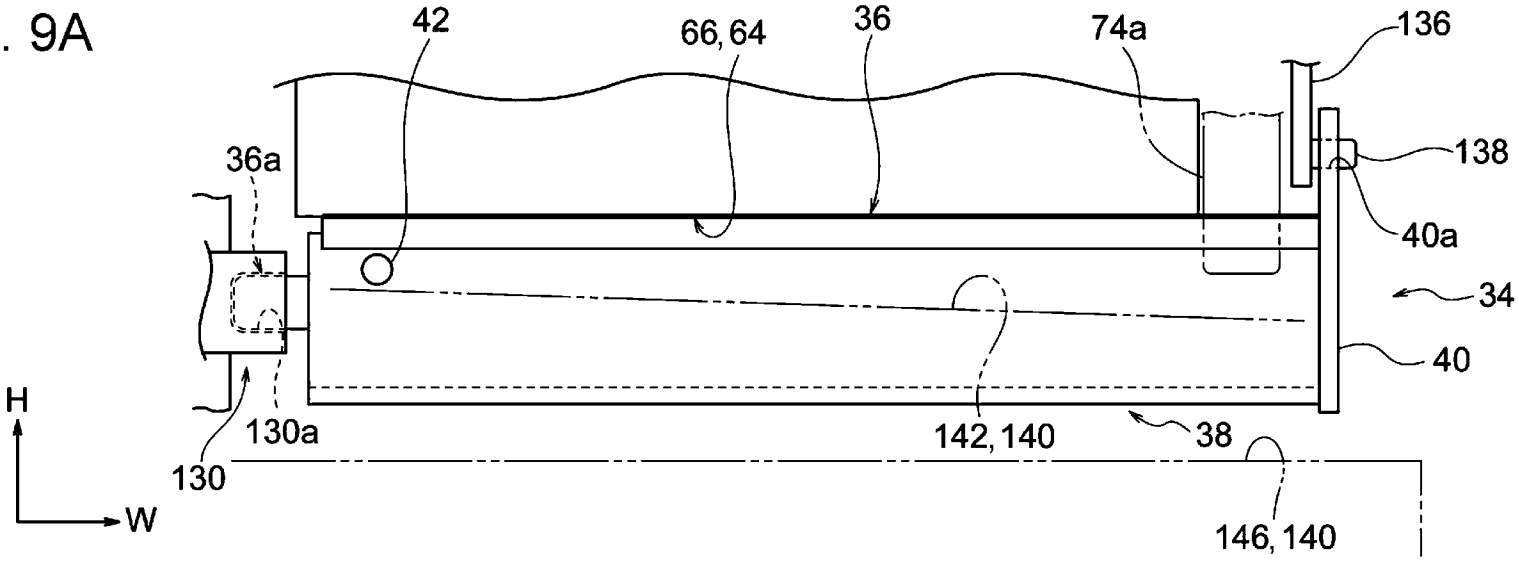
FIGS. 9A and 9B illustrate a detaching process for the image bearing mechanism provided in the image forming apparatus according to the exemplary embodiment of the present disclosure.
Figure 9B:
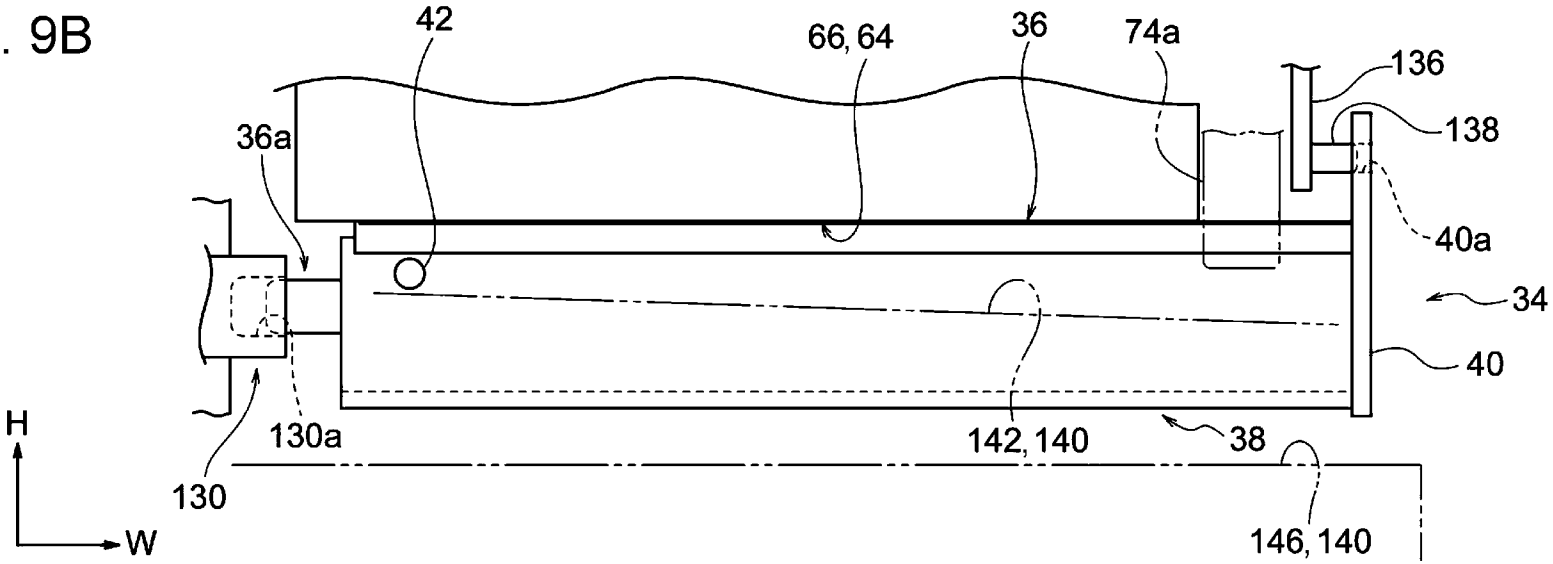

As shown in FIG. 5, the apparatus body 10*a* includes a frame 136 as a structural member having an opening 136*a* through which the image bearing mechanism 34 is attached to and detached from the apparatus body 10*a*. Moreover, the apparatus body 10*a* includes a pair of guide rails 142 for guiding the image bearing mechanism 34 to be attached to or detached from the apparatus body 10*a*, and also includes a support surface 146 that supports the image bearing mechanism 34, to be attached to or detached from the apparatus body 10*a*, from below. As shown in FIGS. 9A and 9B, the guide rails 142 serve as a guide surface inclined downward toward the first side in the apparatus width direction. The support surface 146 extends horizontally toward the first side in the apparatus width direction. As shown in FIG. 9A, the apparatus body 10*a* includes an engagement part 130 to be engaged with engaging parts 36*a* provided in the image bearing members 36.

Door 124

As shown in FIG. 2, the door 124 has a door body 124*a* and hinges 124*b* attached to the lower end of the door body 124*a*, and is movable between a closed position (see FIG. 2) where the door 124 covers the interior of the apparatus body 10*a* and an open position (see FIG. 4) where the door 124 exposes the interior of the apparatus body 10*a*.

Figure 4:
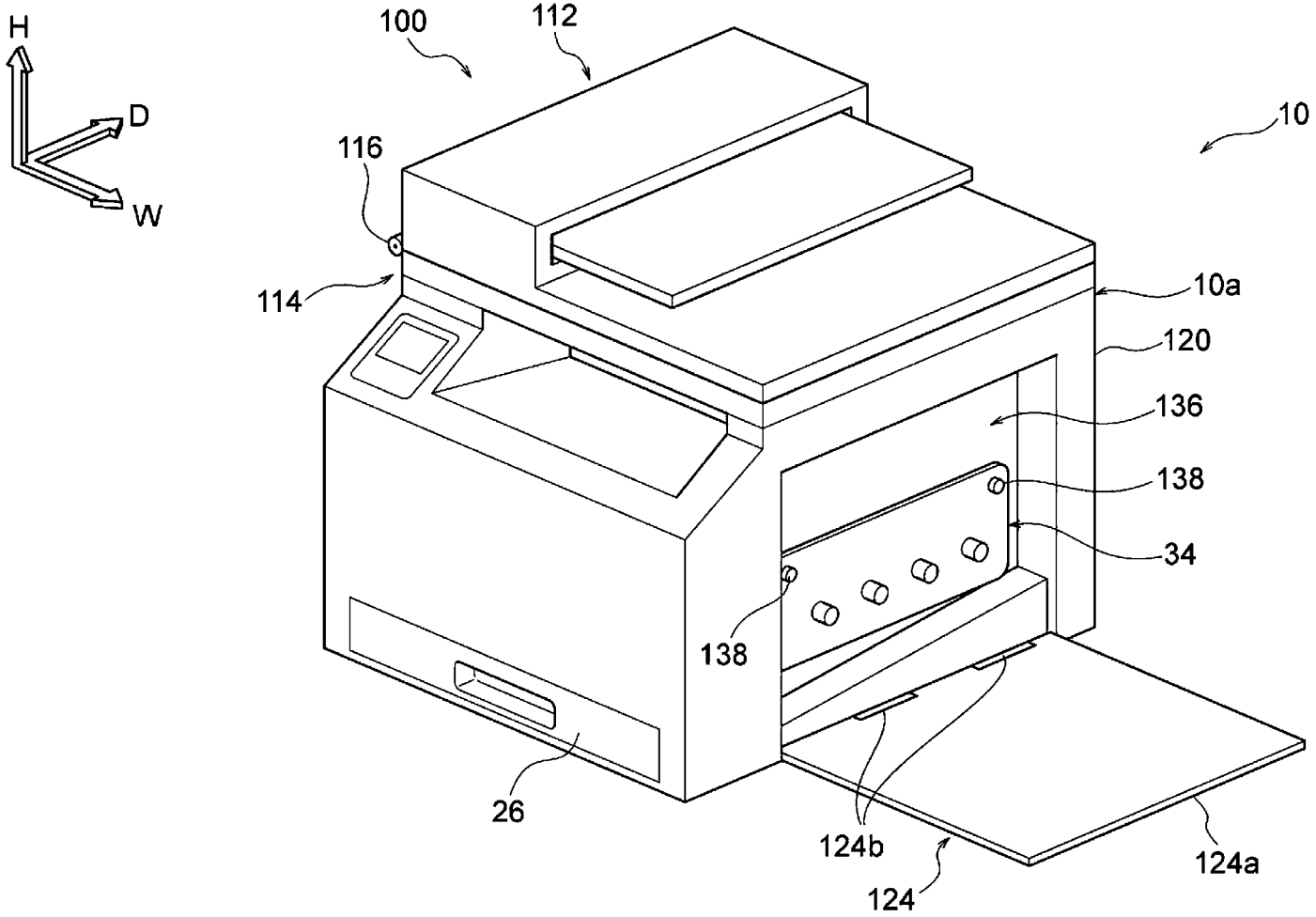
FIG. 4 is an overall perspective view of the image forming apparatus according to the exemplary embodiment of the present disclosure, illustrating a state where the first door is disposed at its open position and the second door is disposed at its closed position.

As shown in FIG. 4, in this configuration, an end of the image bearing mechanism 34 in the apparatus width direction is exposed to the outside when the door 124 is moved to the open position.

Door 126

Figure 1:
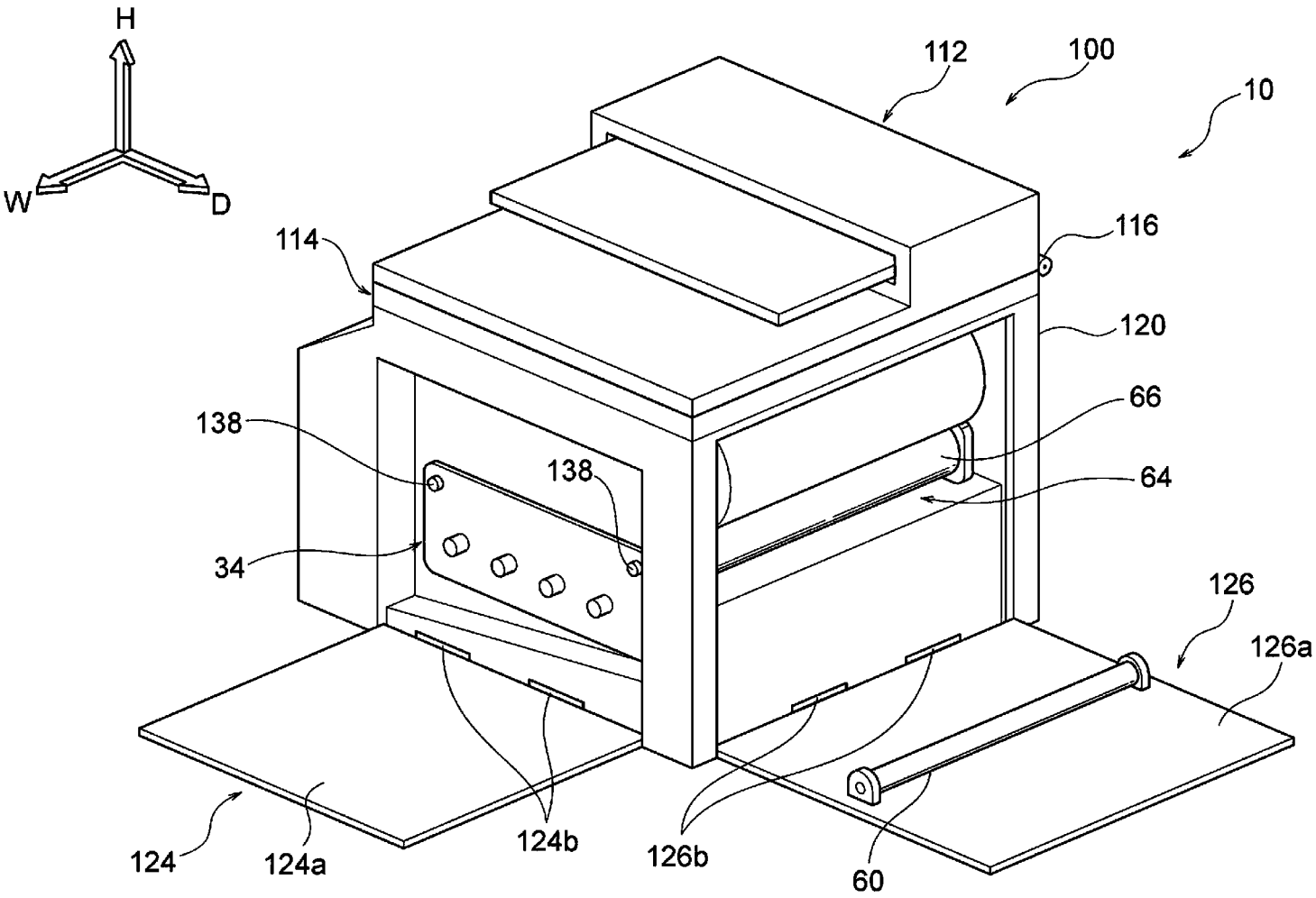
FIG. 1 is an overall perspective view of an image forming apparatus according to an exemplary embodiment of the present disclosure, illustrating a state where first and second doors are disposed at their open positions.

As shown in FIG. 2, the door 126 has a door body 126*a* and hinges 126*b* attached to the lower end of the door body 126*a*, and is movable between a closed position (see FIG. 2) where the door 126 covers the interior of the apparatus body 10*a* and an open position (see FIG. 1) where the door 126 exposes the interior of the apparatus body 10*a*. Furthermore, as shown in FIG. 1, the second-transfer roller 60 is attached to the door 126.

In this configuration, an end of the transfer belt mechanism 64 in the apparatus depth direction is exposed to the outside when the door 124 is moved to the open position.

Frame 136

The frame 136 is formed of a metal sheet whose thickness direction is aligned with the apparatus width direction. As shown in FIG. 5, the frame 136 is exposed to the outside when the door 124 is moved to the open position. The frame 136 has the opening 136*a*, and the image bearing mechanism 34 is attached to and detached from the apparatus body 10*a* through this opening 136*a*. This will be described in detail later.

Furthermore, the frame 136 is provided with pins 138 attached above the opening 136*a* at opposite ends thereof in the apparatus depth direction and protruding toward the first side in the apparatus width direction.

Guide Rails 142 and Support Surface 146

As shown in FIG. 5, the pair of guide rails 142 are provided inside the apparatus body 10*a* and are visually recognizable from the apparatus width direction through the opening 136*a* in the frame 136 when the image bearing mechanism 34 is detached from the apparatus body 10*a*. Furthermore, each of the guide rails 142 is L-shaped in cross section. The pair of guide rails 142 are separated from each other in the apparatus depth direction and extend in the apparatus width direction.

The support surface 146 is an upward-facing surface provided inside the apparatus body 10*a*, is visually recognizable from the apparatus width direction through the opening 136*a* in the frame 136 when the image bearing mechanism 34 is detached from the apparatus body 10*a*, and is disposed below the guide rails 142. The support surface 146 also supports the aforementioned exposure devices 22 for the individual colors.

Engagement Part 130

As shown in FIG. 9A, the engagement part 130 to be engaged with the engaging parts 36*a* provided in the image bearing members 36 is disposed inside the apparatus body 10*a* at a second side in the apparatus width direction. The engagement part 130 has a recess 130*a* into which the engaging parts 36*a* of the image bearing members 36 are fitted.

In this configuration, the engaging parts 36*a* of the image bearing members 36 are fitted into the recess 130*a* of the engagement part 130, so that the engagement part 130 and the engaging parts 36*a* engage with each other. In this state, a rotational driving force is transmitted from the engagement part 130 to the engaging parts 36*a*, whereby the image bearing members 36 rotate.

Image Bearing Mechanism 34

Figure 8:
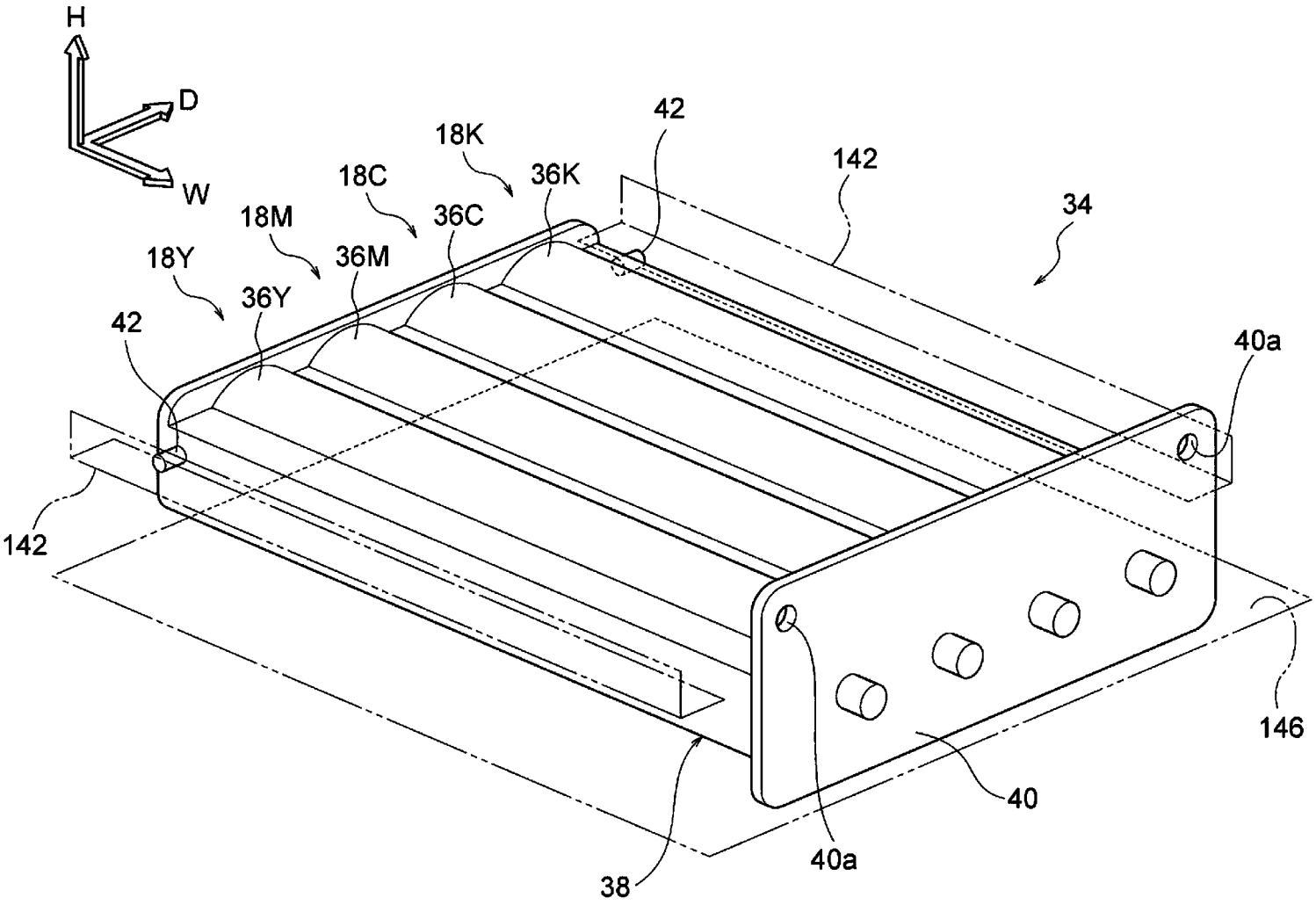
FIG. 8 is a perspective view illustrating the image bearing mechanism provided in the image forming apparatus according to the exemplary embodiment of the present disclosure.

The image bearing mechanism 34 is attached to and detached from the apparatus body 10*a* from the first side in the apparatus width direction. As shown in FIG. 8, the image bearing mechanism 34 has a rectangular shape whose one side and the other side have the same length, as viewed from above, and has a rectangular shape extending in the apparatus depth direction, as viewed from the apparatus width direction. Furthermore, the image bearing mechanism 34 includes the four image forming units 18Y, 18M, 18C, and 18K and the housing 38 that accommodates the image forming units 18 therein. An upper part of the image bearing member 36 provided in each image forming unit 18 is exposed upward through an opening provided in the housing 38.

As shown in FIG. 9A, the second side (i.e., left side), in the apparatus width direction, of the image bearing member 36 provided in each image forming unit 18 is provided with the engaging part 36*a*, and this engaging part 36*a* is exposed from the housing 38 toward the second side in the apparatus width direction. As mentioned above, the engaging parts 36*a* are fitted into the recess 130*a* of the engagement part 130 provided in the apparatus body 10*a*, whereby the engaging parts 36*a* engage with the engagement part 130. A rotational driving force is transmitted to the engaging parts 36*a* from the engagement part 130, whereby the image bearing members 36 rotate. Accordingly, the engaging parts 36*a* function as a rotational-force transmitting unit as well as a positioning unit that positions the second side, in the apparatus width direction, of the image bearing mechanism 34 in the up-down direction.

Furthermore, as shown in FIG. 8, the image bearing mechanism 34 has a side plate 40 that is disposed at the first side of the housing 38 in the apparatus width direction and whose thickness direction is aligned with the apparatus width direction. This side plate 40 has a rectangular shape extending in the apparatus depth direction, as viewed from the apparatus width direction. Upper areas of the side plate 40 located at the opposite ends thereof in the apparatus depth direction are provided with through-holes 40*a* to which the pins 138 (see FIG. 5) attached to the frame 136 are fitted. The pins 138 are fitted into the through-holes 40*a* so that the first side, in the apparatus width direction, of the image bearing mechanism 34 is positioned in the up-down direction. Accordingly, the through-holes 40*a* and the pins 138 function as a positioning unit that positions the first side, in the apparatus width direction, of the image bearing mechanism 34 in the up-down direction.

Furthermore, the second side of the housing 38 in the apparatus width direction is provided with a pair of protrusions 42 protruding forward and rearward in the apparatus depth direction.

In this configuration, as shown in FIG. 9A, when the image bearing mechanism 34 is attached to the apparatus body 10*a*, the engaging parts 36*a* of the image bearing members 36 are fitted in the recess 130*a* of the engagement part 130 of the apparatus body 10*a*, so as to be engaged with the engagement part 130. Moreover, the pins 138 attached to the frame 136 are fitted in the through-holes 40*a* in the side plate 40 of the image bearing mechanism 34. The image bearing members 36 are in contact with the transfer belt 66.

Figure 10A:
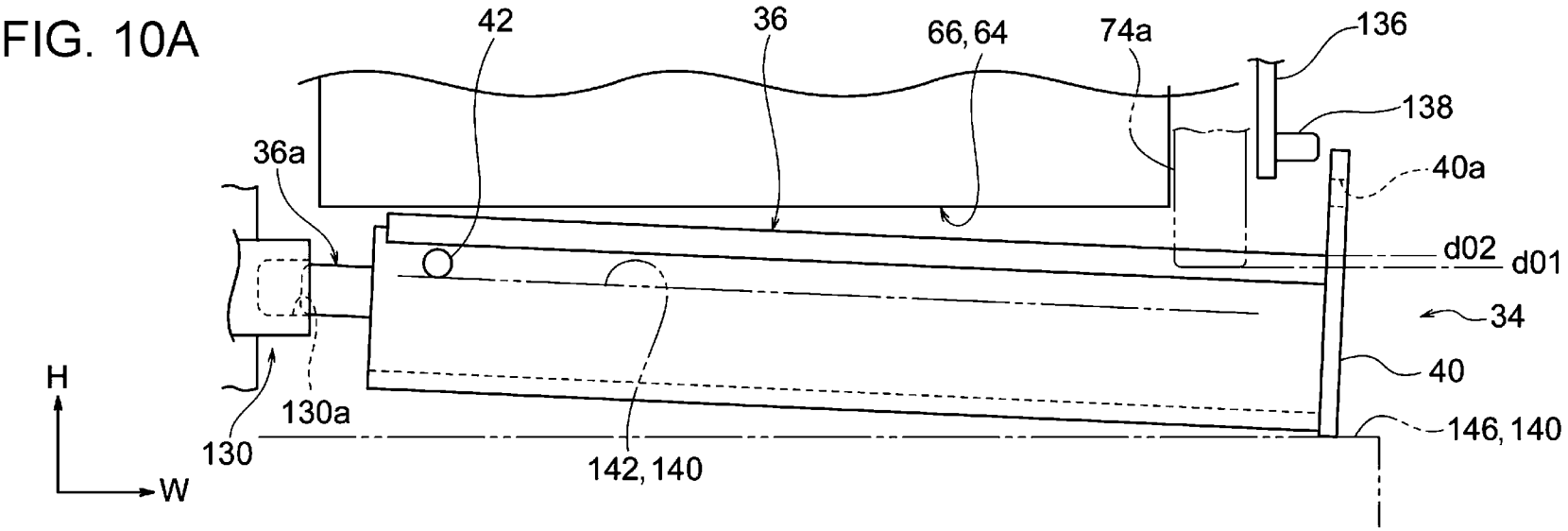
FIGS. 10A and 10B illustrate the detaching process for the image bearing mechanism provided in the image forming apparatus according to the exemplary embodiment of the present disclosure.

Furthermore, when the door 124 is disposed at the open position (see FIG. 4), an operator holds the side plate 40 of the housing 38 and pulls out the pins 138 from the through-holes 40*a* by moving the image bearing mechanism 34 toward the first side in the apparatus width direction, as shown in FIGS. 9B and 10A. In this state, the distal ends of the engaging parts 36*a* of the image bearing members 36 are still fitted in the recess 130*a* of the engagement part 130.

Then, the operator moves the side plate 40 downward and places the side plate 40 on the support surface 146, as shown in FIG. 10A. Consequently, the image bearing mechanism 34 tilts relative to the apparatus width direction, so that the image bearing members 36 are separated from the transfer belt 66. Then, the protrusions 42 in the housing 38 are placed on the guide rails 142. Accordingly, in order to detach the image bearing mechanism 34 from the apparatus body 10*a*, the operator separates the image bearing mechanism 34 from the transfer belt mechanism 64 so as to dispose the image bearing mechanism 34 at a separated position.

The guide rails 142 and the support surface 146 constitute a support member 140 that supports the image bearing mechanism 34 at the separated position.

Specifically, the "separated position of the image bearing mechanism 34" is a position where the image bearing members 36 do not rub against the transfer belt 66 even if the image bearing mechanism 34 is moved in an attaching-detaching direction (i.e., the apparatus width direction in this exemplary embodiment) for detaching the image bearing mechanism 34 from the apparatus body 10*a*. In this exemplary embodiment, this position is where the image bearing mechanism 34 is separated from the transfer belt mechanism 64 in the up-down direction.

Figure 10B:
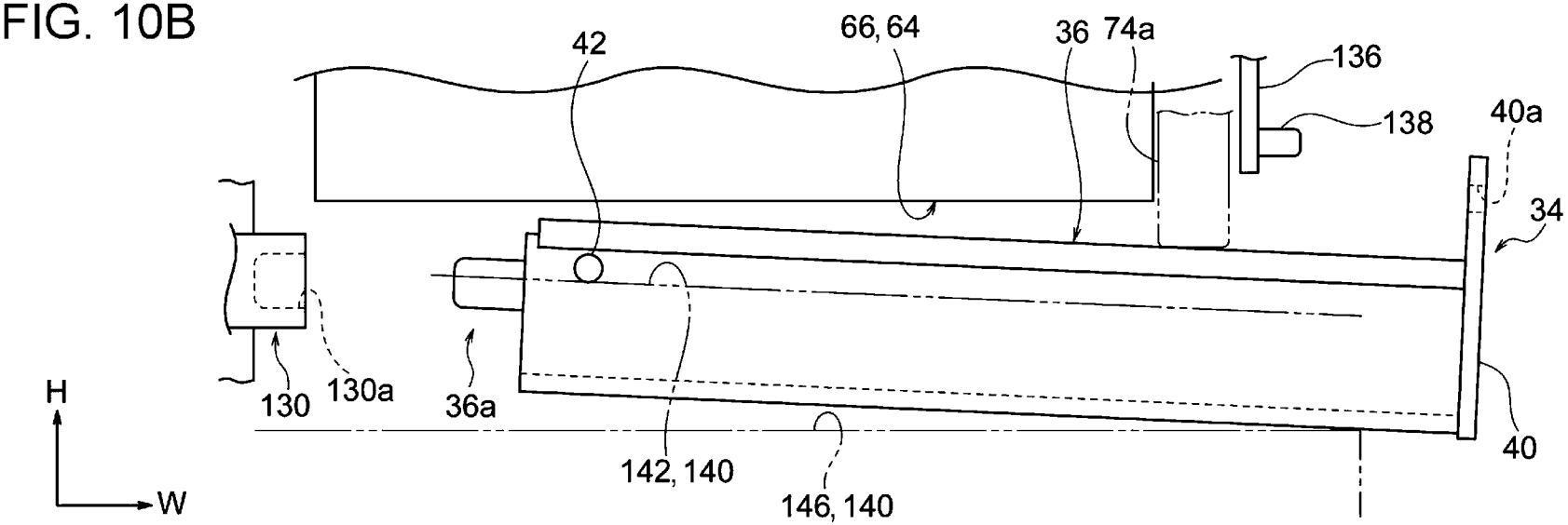

Furthermore, as shown in FIG. 10B, the operator moves the image bearing mechanism 34 in the tilted state so as to detach the image bearing mechanism 34 from the apparatus body 10*a* (see FIG. 5). In this case, the guide rails 142 are tilted downward toward the first side in the apparatus width direction. Moreover, the support surface 146 extends in the horizontal direction toward the first side in the apparatus width direction. Specifically, the guide rails 142 and the support surface 146 are disposed such that the distance therebetween decreases in the attaching-detaching direction (i.e., the detaching direction). Therefore, as the image bearing mechanism 34 is moved in the attaching-detaching direction, the image bearing mechanism 34 rotates about the leading end thereof in the attaching-detaching direction, so that the trailing end of the image bearing mechanism 34 in the attaching-detaching direction descends, whereby the image bearing members 36 are prevented from rubbing against the transfer belt 66.

When the image bearing mechanism 34 detached from the apparatus body 10*a* is to be attached to the apparatus body 10*a*, the image bearing mechanism 34 is attached to the apparatus body 10*a* by performing a reverse process of the above-described process. Accordingly, the image bearing mechanism 34 is attached to and detached from the apparatus body 10*a* in the apparatus width direction. In other words, by moving the image bearing mechanism 34 along the rotation axes of the image bearing members 36, the image bearing mechanism 34 is attached to and detached from the apparatus body 10*a*. The apparatus width direction is an example of a first direction.

Transfer Belt Mechanism 64

Figure 11:
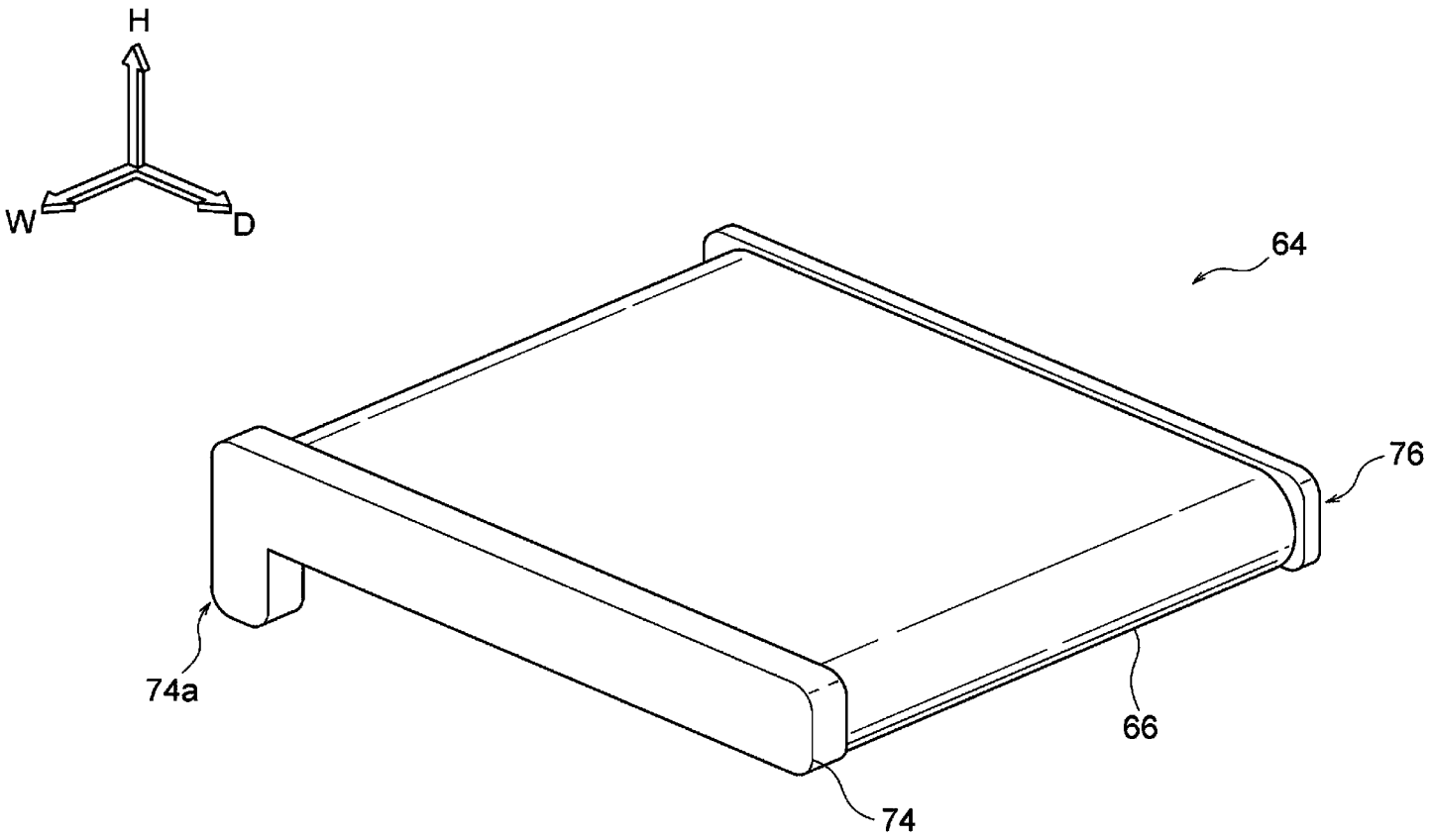
FIG. 11 is a perspective view illustrating the transfer belt mechanism provided in the image forming apparatus according to the exemplary embodiment of the present disclosure.

The transfer belt mechanism 64 is attached to and detached from the apparatus body 10*a* from the rear side in the apparatus depth direction. As shown in FIG. 11, the transfer belt mechanism 64 has a rectangular shape whose one side and the other side have the same length, as viewed from above, and has a rectangular shape extending in the apparatus depth direction, as viewed from the apparatus width direction. Furthermore, the transfer belt mechanism 64 includes the transfer belt 66, the four first-transfer rollers 68 (see FIG. 14), the pair of rollers 70 (see FIG. 14), the frames 74 and 76 that support the components, and a suppressing member 80 (see FIG. 13) that suppresses meandering of the transfer belt 66.

The pair of rollers 70 shown in FIG. 14 have rotation axes aligned with the apparatus width direction and are separated from each other in the apparatus depth direction. The transfer belt 66 is endless and is wrapped around the pair of rollers 70 so as to extend in the apparatus depth direction. The four first-transfer rollers 68 are disposed within the transfer belt 66 and are spaced apart in the apparatus depth direction. One of the rollers 70 rotates by receiving a rotational driving force, thereby causing the transfer belt 66 to rotate.

As shown in FIG. 11, the frame 74 is disposed at the first side of the transfer belt 66 in the apparatus width direction, whereas the frame 76 is disposed at the second side of the transfer belt 66 in the apparatus width direction. The frame 74 and the frame 76 sandwich the transfer belt 66, the first-transfer rollers 68, and the pair of rollers 70 from the apparatus width direction so as to support these components.

Figure 12:
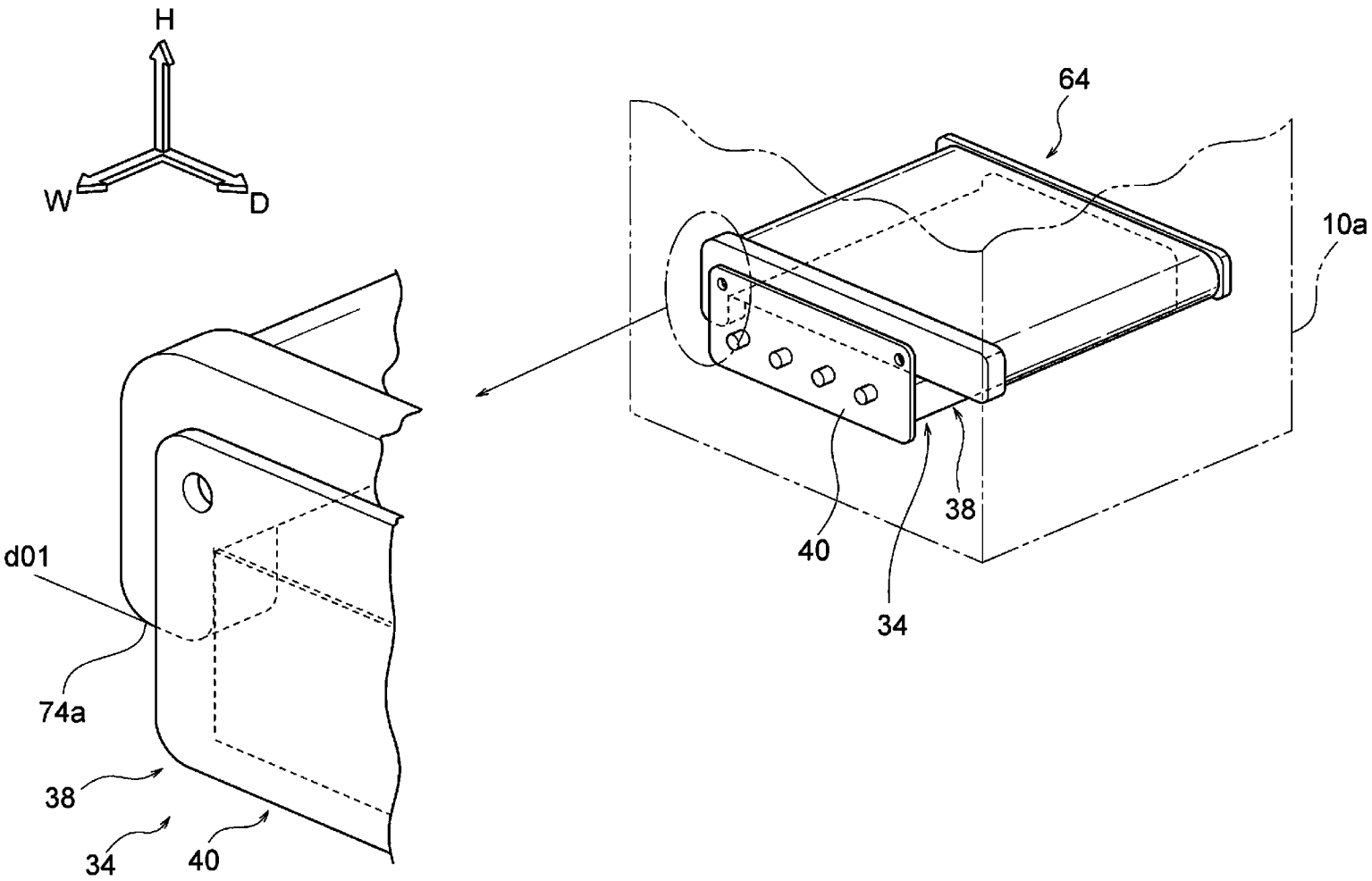
FIG. 12 is a perspective view illustrating the image bearing mechanism and the transfer belt mechanism provided in the image forming apparatus according to the exemplary embodiment of the present disclosure.

Furthermore, a protrusion 74*a* that protrudes downward is provided at the rear side of the frame 74 in the apparatus depth direction. In a state where the transfer belt mechanism 64 and the image bearing mechanism 34 are attached to the apparatus body 10*a*, the protrusion 74*a* is disposed at the front side, in the apparatus depth direction, of the housing 38 of the image bearing mechanism 34, as shown in FIG. 12. Thus, when the transfer belt mechanism 64 attached to the apparatus body 10*a* is moved rearward in the apparatus depth direction to detach the transfer belt mechanism 64 therefrom in a state where the image bearing mechanism 34 is attached to the apparatus body 10*a*, the protrusion 74*a* abuts on the housing 38 of the image bearing mechanism 34. Accordingly, the protrusion 74*a* functions as a movement regulating unit that regulates movement of the transfer belt mechanism 64.

The protruding amount of the protrusion 74*a* is set such that the protrusion 74*a* abuts on the housing 38 of the image bearing mechanism 34 even in a state where the image bearing mechanism 34 is disposed at the separated position (see FIG. 10A) for detaching the image bearing mechanism 34 from the apparatus body 10*a*. In detail, as shown in FIG. 10A, a lower end d01 of the protrusion 74*a* is located below an upper end d02 of an area of the image bearing mechanism 34 disposed at the separated position. Specifically, this area is disposed at the same position as the protrusion 74*a* in the apparatus width direction. The protrusion 74*a* is an example of a regulating unit.

Figure 13:
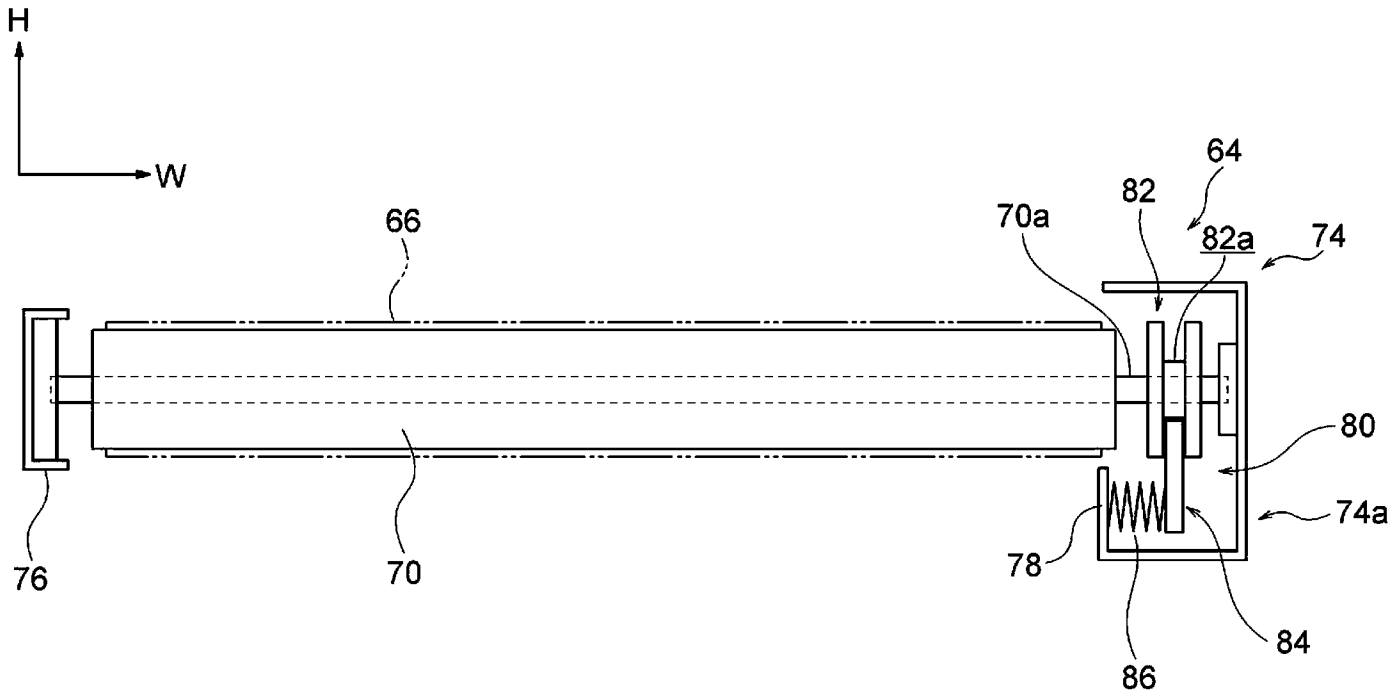
FIG. 13 is a cross-sectional view illustrating the transfer belt mechanism provided in the image forming apparatus according to the exemplary embodiment of the present disclosure.

As shown in FIG. 13, at least a part of the suppressing member 80 that suppresses meandering of the rotating transfer belt 66 is disposed in the protrusion 74*a*. The term "meandering" refers to a state where the transfer belt 66 rotates while continuously shifting between one side and the other side in the axial direction of the rollers 70 around which the transfer belt 66 is wrapped.

The protrusion 74*a* is disposed at the first side, in the apparatus width direction, of the roller 70 disposed at the front side in the apparatus depth direction. the suppressing member 80 provided in the protrusion 74*a* includes a disk member 82 attached to a shaft 70*a* of the roller 70, a pressing member 84, and a compression coil spring 86.

The disk member 82 is attached to the first side of the shaft 70*a* in the apparatus width direction. The disk member 82 is provided with a groove 82*a* extending in the circumferential direction. The pressing member 84 is disposed below the disk member 82. The upper end of the pressing member 84 is fitted in the groove 82*a* of the disk member 82. The compression coil spring 86 extends in the apparatus width direction and is disposed in a compressed state between a side plate 78, constituting the protrusion 74*a* and disposed at the other side of the pressing member 84 in the apparatus width direction, and the lower end of the pressing member 84.

With regard to the second end of the shaft 70*a* of the roller 70 in the apparatus width direction, movement thereof in the apparatus width direction is regulated. Furthermore, the first end of the shaft 70*a* of the roller 70 in the apparatus width direction is supported in a movable manner in the apparatus up-down direction. Accordingly, the roller 70 is supported in a pivotable manner.

In this configuration, the disk member 82 receives a bias force of the compression coil spring 86 via the pressing member 84. In detail, the disk member 82 receives a bias force that biases the disk member 82 toward the first side in the apparatus width direction. Accordingly, tilting of the shaft 70*a* relative to the apparatus width direction is suppressed, so that meandering of the transfer belt 66 wrapped around the rollers 70 is suppressed.

In order to attach and detach the transfer belt mechanism 64 to and from the apparatus body 10*a* from the rear side in the apparatus depth direction, the apparatus body 10*a* is provided with a guide rail (not shown) that guides the transfer belt mechanism 64 in the apparatus depth direction. The apparatus body 10*a* is not provided with a component that inhibits detachment of the transfer belt mechanism 64 from the apparatus body 10*a* when the image bearing mechanism 34 is detached from the apparatus body 10*a*.

Figure 6:
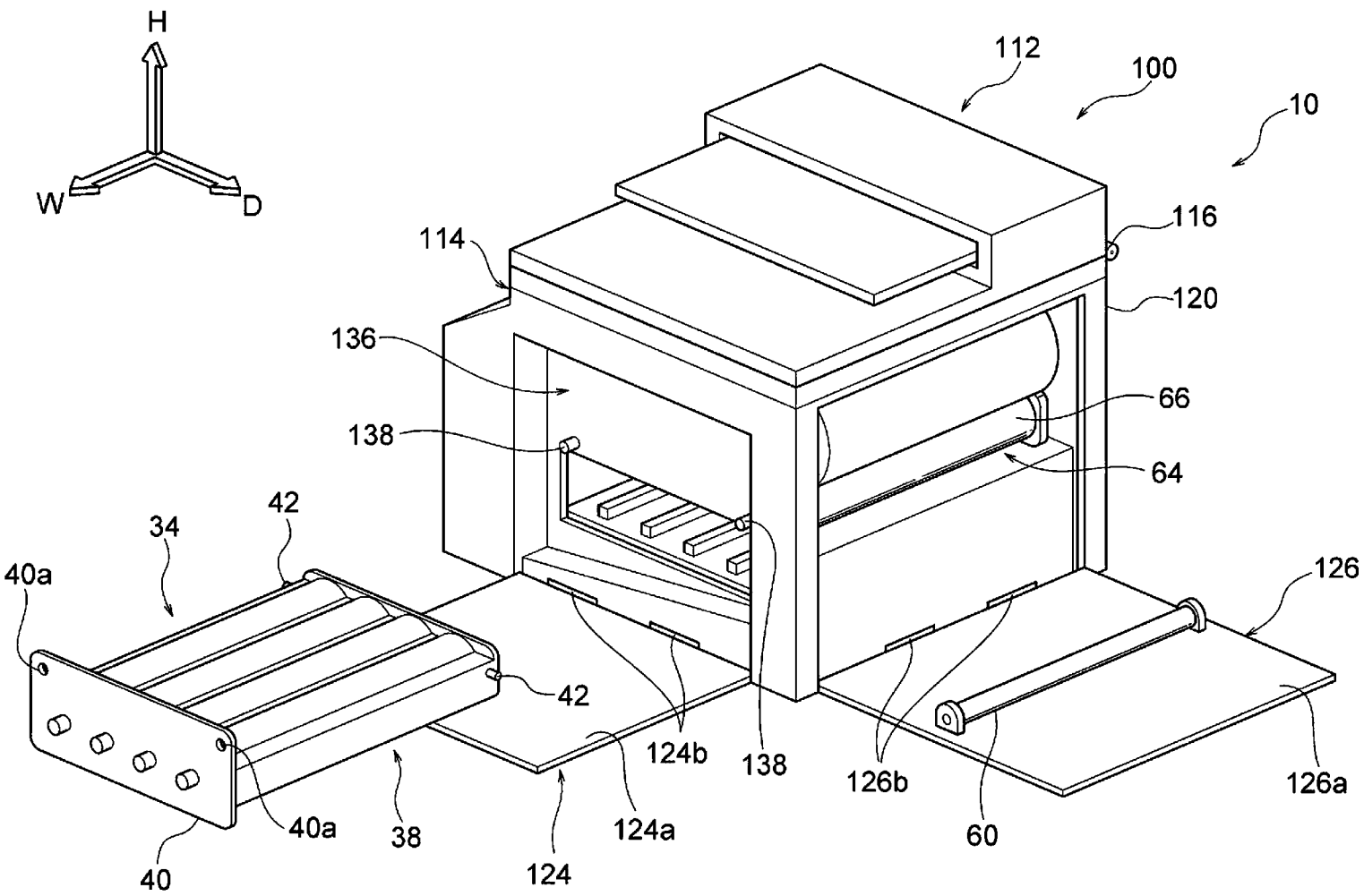
FIG. 6 is an overall perspective view of the image forming apparatus according to the exemplary embodiment of the present disclosure, illustrating a state where the first and second doors are both disposed at their open positions and the image bearing mechanism is detached.
Figure 7:
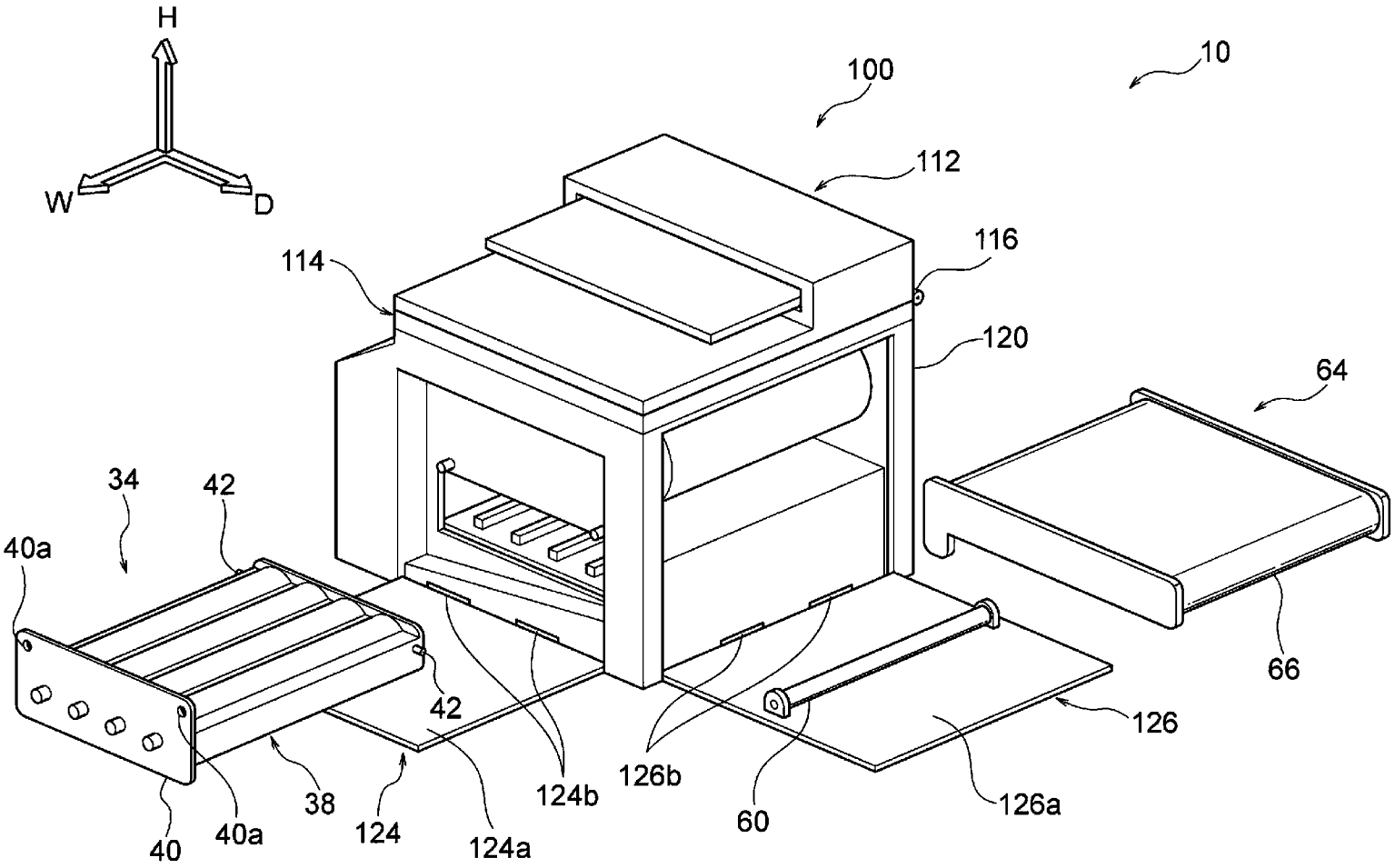
FIG. 7 is an overall perspective view of the image forming apparatus according to the exemplary embodiment of the present disclosure, illustrating a state where the first and second doors are both disposed at their open positions and the image bearing mechanism and a transfer belt mechanism are detached.

In this configuration, as shown in FIGS. 6 and 7, the transfer belt mechanism 64 attached to the apparatus body 10*a* is moved rearward in the apparatus depth direction in a state where the image bearing mechanism 34 is detached from the apparatus body 10*a*. Accordingly, the transfer belt mechanism 64 detaches from the apparatus body 10*a*.

When the transfer belt mechanism 64 detached from the apparatus body 10*a* is to be attached to the apparatus body 10*a*, the transfer belt mechanism 64 is attached to the apparatus body 10*a* by performing a reverse process of the above-described process. Accordingly, the transfer belt mechanism 64 is attached to and detached from the apparatus body 10*a* in the apparatus depth direction. In other words, by moving the transfer belt mechanism 64 in a direction orthogonal to the rotation axis of the transfer belt 66, the transfer belt mechanism 64 is attached to and detached from the apparatus body 10*a*. The apparatus depth direction is an example of a second direction.

Operation of Relevant Components

The following description relates to a process for detaching the image bearing mechanism 34 and the transfer belt mechanism 64 attached to the apparatus body 10*a* from the apparatus body 10*a*, and to a process for attaching the image bearing mechanism 34 and the transfer belt mechanism 64 detached from the apparatus body 10*a* to the apparatus body 10*a*.

Detaching Process

As shown in FIGS. 2 and 3, when the image forming apparatus 10 is in operation, the doors 124 and 126 for maintenance are disposed at their closed positions. When the image bearing mechanism 34 is attached to the apparatus body 10*a*, the transfer belt mechanism 64 attached to the apparatus body 10*a* is not detachable therefrom.

First, as shown in FIGS. 3 and 4, the operator moves the door 124 at the closed position to the open position. Moreover, the operator moves the image bearing mechanism 34 toward the first side in the apparatus width direction so as to detach the image bearing mechanism 34 from the apparatus body 10*a*, as shown in FIG. 5.

In detail, the operator holds the side plate 40 of the housing 38 and pulls out the pins 138 from the through-holes 40*a* by moving the image bearing mechanism 34 toward the first side in the apparatus width direction, as shown in FIGS. 9A and 9B. In this state, the distal ends of the engaging parts 36*a* of the image bearing members 36 are fitted in the recess 130*a* of the engagement part 130.

Then, the operator moves the side plate 40 downward and places the side plate 40 on the support surface 146, as shown in FIG. 10A. Consequently, the image bearing mechanism 34 tilts relative to the apparatus width direction, so that the image bearing members 36 are separated from the transfer belt 66. Then, the protrusions 42 in the housing 38 are placed on the guide rails 142. Accordingly, in order to detach the image bearing mechanism 34 from the apparatus body 10*a*, the image bearing mechanism 34 is separated from the transfer belt mechanism 64 so that the image bearing mechanism 34 is disposed at the separated position.

Furthermore, as shown in FIG. 10B, the operator moves the image bearing mechanism 34 in the tilted state so as to detach the image bearing mechanism 34 from the apparatus body 10*a* while the image bearing mechanism 34 extends along the support surface 146 (see FIG. 5).

Subsequently, in order to detach the transfer belt mechanism 64 from the apparatus body 10*a*, the operator moves the door 126 at the closed position to the open position, as shown in FIG. 6. Moreover, the operator moves the transfer belt mechanism 64 rearward in the apparatus depth direction so as to detach the transfer belt mechanism 64 from the apparatus body 10*a*, as shown in FIG. 7.

Attaching Process

The image bearing mechanism 34 and the transfer belt mechanism 64 detached from the apparatus body 10*a* are attached to the apparatus body 10*a* by performing a reverse process of the above-described process.

In detail, the operator first moves the transfer belt mechanism 64 forward in the apparatus depth direction so as to attach the transfer belt mechanism 64 to the apparatus body 10*a*. Furthermore, the operator moves the image bearing mechanism 34 toward the second side in the apparatus width direction so as to attach the image bearing mechanism 34 to the apparatus body 10*a*.

CONCLUSION

As described above, in the image forming apparatus 10, the direction in which the image bearing mechanism 34 equipped with the multiple image bearing members 36 is attached to and detached from the apparatus body 10*a* is different from the direction in which the transfer belt mechanism 64 is attached to and detached from the apparatus body 10*a*. For example, if the direction in which the transfer belt mechanism is attached to and detached from the apparatus body is the same as the direction in which the image bearing mechanism is attached to and detached from the apparatus body, the frame of the image forming apparatus has to have a large opening. When the frame has such a large opening, the rigidity of the frame decreases. In order to maintain the rigidity of the frame, the frame has to be increased in size, or the frame has to be increased in wall thickness.

In contrast, as mentioned above, in the image forming apparatus 10, the direction in which the image bearing mechanism 34 is attached to and detached from the apparatus body 10*a* is different from the direction in which the transfer belt mechanism 64 is attached to and detached from the apparatus body 10*a*. Therefore, as compared with a case where the direction in which the transfer belt mechanism is attached to and detached from the apparatus body is the same as the direction in which the image bearing mechanism is attached to and detached from the apparatus body, the frame does not have to have a large opening, thereby suppressing an increase in size of the frame 136 and an increase in wall thickness of the frame 136.

Furthermore, in the image forming apparatus 10, the attaching-detaching direction of the image bearing mechanism 34 intersects the attaching-detaching direction of the transfer belt mechanism 64 in a top view, and the attaching-detaching direction of the image bearing mechanism 34 is parallel to the attaching-detaching direction of the transfer belt mechanism 64 in a side view from the apparatus width direction or the apparatus depth direction. Therefore, as compared with a case where the attaching-detaching direction of the image bearing mechanism 34 intersects the attaching-detaching direction of the transfer belt mechanism 64 in the side view, the movable range of the transfer belt mechanism 64 and the image bearing mechanism 34 in the up-down direction is reduced, thereby suppressing an increase in height of the apparatus body 10*a*.

Furthermore, in the image forming apparatus 10, the image bearing mechanism 34 is attached to and detached from the apparatus body 10*a* along the rotation axes of the image bearing members 36, and the transfer belt mechanism 64 is attached to and detached from the apparatus body 10*a* in the direction orthogonal to the rotation axis of the transfer belt 66. Therefore, as compared with a case where the image bearing mechanism is attached to and detached from the apparatus body in a direction tilted relative to the rotation axes of the image bearing members and the transfer belt mechanism is attached to and detached from the apparatus body in a direction tilted relative to the rotation axis of the transfer belt, an increase in distances by which the mechanisms are moved for the attaching and detaching processes may be suppressed.

Furthermore, in the image forming apparatus 10, the protrusion 74*a* regulates the detachment of the transfer belt mechanism 64 attached to the apparatus body 10*a* from the apparatus body 10*a* when the image bearing mechanism 34 is attached to the apparatus body 10*a*. Therefore, as compared with a case where the transfer belt mechanism attached to the apparatus body is detachable from the apparatus body when the image bearing mechanism is attached to the apparatus body, a situation where the transfer belt 66 rubs against the image bearing members 36 as a result of an attaching or detaching process of the transfer belt mechanism 64 may be suppressed.

Furthermore, in the image forming apparatus 10, when the transfer belt mechanism 64 attached to the apparatus body 10*a* is to be detached from the apparatus body 10*a*, the protrusion 74*a* abuts on the housing 38 of the image bearing mechanism 34, so that the detachment of the transfer belt mechanism 64 from the apparatus body 10*a* is regulated. Accordingly, as compared with a case where the detachment of the transfer belt mechanism from the apparatus body is regulated by using a mechanism that requires mechanical operation, the detachment of the transfer belt mechanism 64 from the apparatus body 10*a* may be regulated with a simple configuration.

Furthermore, in the image forming apparatus 10, at least a part of the suppressing member 80 that suppresses meandering of the rotating transfer belt 66 is disposed in the protrusion 74*a*. Therefore, as compared with a case where the suppressing member 80 is disposed in a dedicated region, an increase in size of the apparatus body 10*a* may be suppressed.

Furthermore, in the image forming apparatus 10, the protruding amount of the protrusion 74*a* is set such that the protrusion 74*a* abuts on the housing 38 of the image bearing mechanism 34 even in a state where the image bearing mechanism 34 is disposed at the separated position (see FIG. 10A) for detaching the image bearing mechanism 34 from the apparatus body 10*a*. Even in a state where the image bearing mechanism 34 is separated from the transfer belt mechanism 64 for detaching the image bearing mechanism 34 from the apparatus body 10*a*, the detachment of the transfer belt mechanism 64 from the apparatus body 10*a* is regulated. Therefore, the attaching sequence and the detaching sequence for the image bearing mechanism 34 and the transfer belt mechanism 64 relative to the image forming apparatus 10 are predetermined. As compared with a case where there is a degree of freedom in terms of the attaching and detaching sequences, the apparatus may be reduced in size.

Although a specific exemplary embodiment of the present disclosure has been described above, the present disclosure is not limited to the exemplary embodiment. It is obvious to a skilled person that other various exemplary embodiments are possible within the scope of the disclosure. For example, in the above exemplary embodiment, when the transfer belt mechanism 64 attached to the apparatus body 10*a* is to be detached from the apparatus body 10*a*, the protrusion 74*a* abuts on the housing 38 of the image bearing mechanism 34, so that the detachment of the transfer belt mechanism 64 is regulated. Alternatively, the detachment of the transfer belt mechanism may be regulated by using a mechanism that requires mechanical operation for holding and releasing the transfer belt mechanism. However, in this case, the effect exhibited by causing the protrusion 74*a* to abut on the housing 38 of the image bearing mechanism 34 to regulate the detachment of the transfer belt mechanism 64 is not exhibited.

Furthermore, in the above exemplary embodiment, the protruding amount of the protrusion 74*a* is increased so that the detachment of the transfer belt mechanism 64 from the apparatus body 10*a* is regulated even in a state where the image bearing mechanism 34 is disposed at the separated position. Alternatively, for example, a position sensor that detects the position of the image bearing mechanism 34 may be provided to detect that the image bearing mechanism 34 is disposed at the separated position. Based on this detection result, the detachment of the transfer belt mechanism may be regulated by using a mechanism that requires mechanical operation for holding or releasing the transfer belt mechanism. However, in this case, the effect exhibited by increasing the protruding amount of the protrusion 74*a* to regulate the detachment of the transfer belt mechanism 64 from the apparatus body 10*a* even in a state where the image bearing mechanism 34 is disposed at the separated position is not exhibited.

Furthermore, in the above exemplary embodiment, the attaching-detaching direction of the image bearing mechanism 34 is parallel to the attaching-detaching direction of the transfer belt mechanism 64 in a side view. Alternatively, the attaching-detaching direction of the image bearing mechanism 34 and the attaching-detaching direction of the transfer belt mechanism 64 may intersect each other in the side view. However, in this case, the effect exhibited when the attaching-detaching direction of the image bearing mechanism 34 is parallel to the attaching-detaching direction of the transfer belt mechanism 64 in the side view is not exhibited.

Furthermore, in the above exemplary embodiment, the image bearing mechanism 34 is attached to and detached from the apparatus body 10*a* along the rotation axes of the image bearing members 36, and the transfer belt mechanism 64 is attached to and detached from the apparatus body 10*a* in the direction orthogonal to the rotation axis of the transfer belt 66. Alternatively, the image bearing mechanism may be attached to and detached from the apparatus body in a direction tilted relative to the rotation axes of the image bearing members, and the transfer belt mechanism may be attached to and detached from the apparatus body in a direction tilted relative to the direction orthogonal to the rotation axis of the transfer belt. However, in this case, the effect exhibited when the image bearing mechanism 34 is attached to and detached from the apparatus body 10*a* along the rotation axes of the image bearing members 36 and the transfer belt mechanism 64 is attached to and detached from the apparatus body 10*a* in the direction orthogonal to the rotation axis of the transfer belt 66 is not exhibited.

Furthermore, as an alternative to the above exemplary embodiment in which at least a part of the suppressing member 80 that suppresses meandering of the rotating transfer belt 66 is disposed in the protrusion 74*a*, for example, another functional member, such as a clutch, may be disposed in the protrusion 74*a*.

Furthermore, although at least a part of the suppressing member 80 that suppresses meandering of the rotating transfer belt 66 is disposed in the protrusion 74*a* in the above exemplary embodiment, a suppressing member does not have to be disposed therein. However, in this case, the effect exhibited by disposing a suppressing member in the protrusion 74*a* is not exhibited.

Furthermore, although not specified in the above exemplary embodiment, for example, a detachable waste toner box may be disposed between the door 124 and the image bearing mechanism 34.

Furthermore, in the above exemplary embodiment, the image bearing mechanism 34 is attached to and detached from the apparatus body 10*a* in the apparatus width direction, and the transfer belt mechanism 64 is attached to and detached from the apparatus body 10*a* in the apparatus depth direction. Alternatively, the image bearing mechanism 34 may be attached to and detached from the apparatus body 10*a* in the apparatus depth direction, and the transfer belt mechanism 64 may be attached to and detached from the apparatus body 10*a* in the apparatus width direction, so long as the attaching-detaching direction of the image bearing mechanism 34 and the attaching-detaching direction of the transfer belt mechanism 64 are different from each other.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The exemplary embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image bearing mechanism that is attachable to and detachable from an apparatus body in a first direction and that supports a plurality of image bearing members, each image bearing member having a surface onto which an image is formed while the image bearing member rotates;

a transfer belt mechanism including a transfer belt onto which the images on the plurality of image bearing members are transferred while the image bearing members rotate, the transfer belt mechanism being attachable to and detachable from the apparatus body in a second direction different from the first direction, and a regulating unit provided on the transfer belt mechanism that is configured to prevent detachment of the transfer belt mechanism when the image bearing mechanism is attached to the apparatus body, wherein the regulating unit is a protrusion provided in the transfer belt mechanism, the protrusion abutting on the image bearing mechanism when the transfer belt mechanism attached to the apparatus body is to be detached from the apparatus body.

2. The image forming apparatus according to claim 1, wherein the first direction intersects the second direction in a top view, and the first direction is parallel to the second direction in a side view.

3. The image forming apparatus according to claim 2, wherein the image bearing mechanism is attachable to and detachable from the apparatus body along rotation axes of the plurality of the image bearing members, and wherein the transfer belt mechanism is attachable to and detachable from the apparatus body in a direction orthogonal to a rotation axis of the transfer belt.

4. The image forming apparatus according to claim 1, wherein at least a part of a suppressing member that suppresses meandering of the transfer belt in a rotating state is disposed in the protrusion.

5. The image forming apparatus according to claim 1, further comprising:

a support member that separates the image bearing mechanism from the transfer belt mechanism and supports the image bearing mechanism at a separated position for detaching the image bearing mechanism from the apparatus body, wherein the regulating unit regulates the detachment of the transfer belt mechanism attached to the apparatus body from the apparatus body even in a state where the image bearing mechanism is supported at the separated position.

6. The image forming apparatus according to claim 5, wherein the support member has a guide surface that supports the image bearing mechanism and guides attachment and detachment thereof, and also has a support surface that supports a lower end of the image bearing mechanism, wherein the guide surface and the support surface are disposed such that a distance therebetween decreases in an attaching-detaching direction.

7. An image forming apparatus comprising:

an image bearing mechanism that is attachable to and detachable from an apparatus body in a first direction and that supports a plurality of image bearing members, each image bearing member having a surface onto which an image is formed while the image bearing member rotates;

a transfer belt mechanism including a transfer belt onto which the images on the plurality of image bearing members are transferred while the image bearing members rotate, the transfer belt mechanism being attachable to and detachable from the apparatus body in a second direction different from the first direction, and a regulating unit that is a protrusion provided in the transfer belt mechanism, the protrusion abutting on the image bearing mechanism when the transfer belt mechanism attached to the apparatus body is to be detached from the apparatus body, wherein at least a part of a suppressing member that suppresses meandering of the transfer belt in a rotating state is disposed in the protrusion.

8. The image forming apparatus according to claim 7, further comprising:

a support member that separates the image bearing mechanism from the transfer belt mechanism and supports the image bearing mechanism at a separated position for detaching the image bearing mechanism from the apparatus body, wherein a protruding amount of the protrusion is set such that the protrusion abuts on the image bearing mechanism even in a state where the image bearing mechanism is supported at the separated position.

9. The image forming apparatus according to claim 8, wherein the support member has a guide surface that supports the image bearing mechanism and guides attachment and detachment thereof, and also has a support surface that supports a lower end of the image bearing mechanism, wherein the guide surface and the support surface are disposed such that a distance therebetween decreases in an attaching-detaching direction.

10. The image forming apparatus according to claim 7, further comprising:

a support member that separates the image bearing mechanism from the transfer belt mechanism and supports the image bearing mechanism at a separated position for detaching the image bearing mechanism from the apparatus body, wherein a protruding amount of the protrusion is set such that the protrusion abuts on the image bearing mechanism even in a state where the image bearing mechanism is supported at the separated position.

* * * * *